US009335683B2

(12) United States Patent
Ishigaya et al.

(10) Patent No.: US 9,335,683 B2
(45) Date of Patent: May 10, 2016

(54) FIXING DEVICE AND IMAGE FORMING APPARATUS

(71) Applicants: Yasunori Ishigaya, Kanagawa (JP); Keita Maejima, Kanagawa (JP)

(72) Inventors: Yasunori Ishigaya, Kanagawa (JP); Keita Maejima, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/641,817

(22) Filed: Mar. 9, 2015

(65) Prior Publication Data

US 2015/0261151 A1 Sep. 17, 2015

(30) Foreign Application Priority Data

Mar. 14, 2014 (JP) ..... 2014-051933

(51) Int. Cl.
*G03G 15/20* (2006.01)

(52) U.S. Cl.
CPC ..... *G03G 15/205* (2013.01); *G03G 15/2039* (2013.01); *G03G 15/2082* (2013.01)

(58) Field of Classification Search
CPC ..... G03G 15/2039; G03G 15/2042; G03G 15/2046; G03G 15/2078; G03G 15/2082; G03G 15/205
See application file for complete search history.

(56) References Cited

U.S. PATENT DOCUMENTS 5,041,718 A * 8/1991 d'Hondt ..... G03G 15/2042 219/216
6,385,410 B1 * 5/2002 Hanyu ..... G03G 15/2064 399/337
6,810,220 B2 * 10/2004 Hamada ..... G03G 15/205 219/216
7,027,075 B2 * 4/2006 Yokoi ..... 347/156
8,886,090 B2 * 11/2014 Kawata et al. ..... 399/122
2003/0059235 A1 * 3/2003 Senda ..... G03G 15/2042 399/330
2008/0240748 A1 * 10/2008 Kinouchi et al. ..... 399/33
2009/0028595 A1 * 1/2009 Yano ..... 399/69
2009/0285592 A1 * 11/2009 Nakatani ..... G03G 15/2039 399/70
2011/0194870 A1 8/2011 Hase et al.
2011/0229200 A1 * 9/2011 Yamaguchi et al. ..... 399/122
2012/0219308 A1 * 8/2012 Fukaya ..... 399/33
2013/0071134 A1 * 3/2013 Hikari ..... G03G 15/80 399/88
2013/0188991 A1 * 7/2013 Kawata et al. ..... 399/122
2014/0133880 A1 * 5/2014 Otsuka ..... G03G 15/2078 399/70

(Continued)

FOREIGN PATENT DOCUMENTS

JP 2011-164264 8/2011
JP 2012-177790 9/2012

OTHER PUBLICATIONS

U.S. Appl. No. 14/446,812, filed Jul. 30, 2014.

*Primary Examiner* — David Gray
*Assistant Examiner* — Carla Therrien
(74) *Attorney, Agent, or Firm* — Duft Bornsen & Fettig LLP

(57) ABSTRACT

A fixing device includes a pressure rotator pressed against a fixing rotator to form a fixing nip therebetween, through which a recording medium bearing a toner image is conveyed. A first heater is disposed opposite and heats a first heated span on the fixing rotator spanning in an axial direction thereof. A second heater is disposed opposite and heats a second heated span on the fixing rotator spanning in the axial direction thereof. A temperature sensor unit is disposed opposite an outer circumferential surface of the fixing rotator and includes a first temperature detection element to detect a first temperature of the first heated span on the outer circumferential surface of the fixing rotator and a second temperature detection element to detect a second temperature of the second heated span on the outer circumferential surface of the fixing rotator.

13 Claims, 8 Drawing Sheets

(56) References Cited

U.S. PATENT DOCUMENTS

2014/0356036 A1* 12/2014 Shimokawa ..... G03G 15/2053 399/329
2014/0356037 A1* 12/2014 Shimokawa ..... G03G 15/2053 399/329
2015/0050046 A1* 2/2015 Honda et al. ..... 399/122

* cited by examiner

FIXING DEVICE AND IMAGE FORMING APPARATUS

CROSS-REFERENCE TO RELATED APPLICATION

This patent application is based on and claims priority pursuant to 35 U.S.C. §119 to Japanese Patent Application No. 2014-051933, filed on Mar. 14, 2014, in the Japanese Patent Office, the entire disclosure of which is hereby incorporated by reference herein.

BACKGROUND

1. Technical Field

Exemplary aspects of the present disclosure relate to a fixing device and an image forming apparatus, and more particularly, to a fixing device for fixing a toner image on a recording medium and an image forming apparatus incorporating the fixing device.

2. Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and a pressure rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the pressure rotator apply heat and pressure to the recording medium, melting and fixing the toner image on the recording medium.

SUMMARY

This specification describes below an improved fixing device. In one exemplary embodiment, the fixing device includes a fixing rotator and a pressure rotator pressed against the fixing rotator to form a fixing nip therebetween, through which a recording medium bearing a toner image is conveyed. A first heater is disposed opposite and heats a first heated span on the fixing rotator spanning in an axial direction thereof. A second heater is disposed opposite and heats a second heated span on the fixing rotator spanning in the axial direction thereof. A temperature sensor unit is disposed opposite an outer circumferential surface of the fixing rotator and includes a first temperature detection element to detect a first temperature of the first heated span on the outer circumferential surface of the fixing rotator and a second temperature detection element to detect a second temperature of the second heated span on the outer circumferential surface of the fixing rotator.

This specification further describes an improved image forming apparatus. In one exemplary embodiment, the image forming apparatus includes an image forming device to form a toner image and a fixing rotator disposed downstream from the image forming device in a recording medium conveyance direction to fix the toner image on a recording medium. A pressure rotator is pressed against the fixing rotator to form a fixing nip therebetween, through which the recording medium bearing the toner image is conveyed. A first heater is disposed opposite and heats a first heated span on the fixing rotator spanning in an axial direction thereof. A second heater is disposed opposite and heats a second heated span on the fixing rotator spanning in the axial direction thereof. A temperature sensor unit is disposed opposite an outer circumferential surface of the fixing rotator and includes a first temperature detection element to detect a first temperature of the first heated span on the outer circumferential surface of the fixing rotator and a second temperature detection element to detect a second temperature of the second heated span on the outer circumferential surface of the fixing rotator.

BRIEF DESCRIPTION OF THE DRAWINGS

A more complete appreciation of the disclosure and the many attendant advantages thereof will be readily obtained as the same becomes better understood by reference to the following detailed description when considered in connection with the accompanying drawings, wherein.

DETAILED DESCRIPTION OF THE DISCLOSURE

Figure 1:
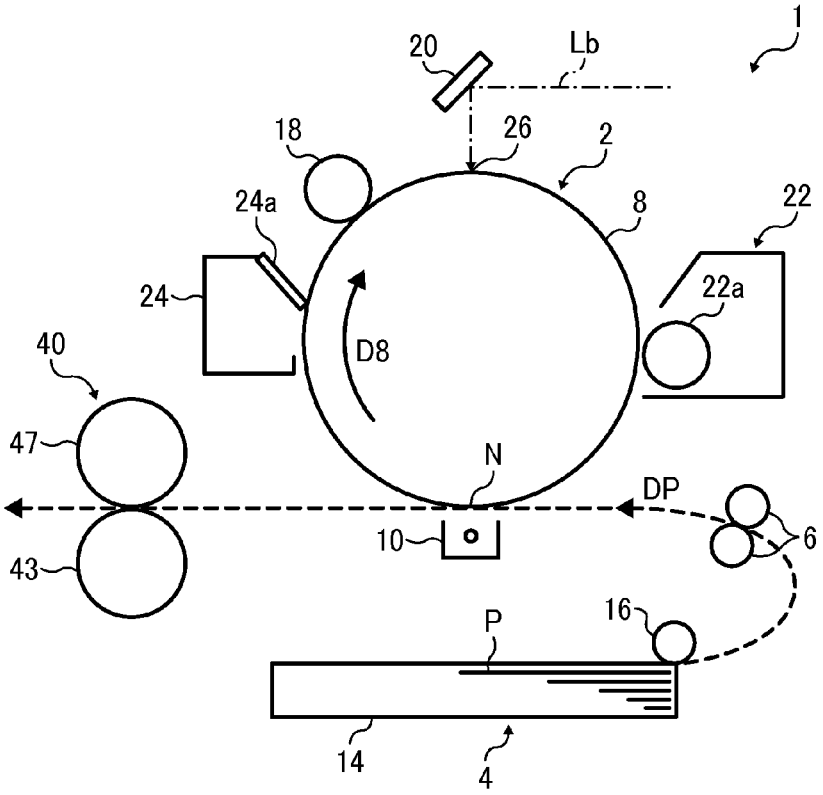
FIG. 1 is a schematic vertical sectional view of an image forming apparatus according to an exemplary embodiment of the present disclosure.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to an exemplary embodiment of the present disclosure is explained.

It is to be noted that, in the drawings for explaining exemplary embodiments of this disclosure, identical reference numerals are assigned, as long as discrimination is possible, to components such as members and component parts having an identical function or shape, thus omitting description thereof once it is provided.

FIG. 1 is a schematic vertical sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a printer that forms a monochrome toner image on a recording medium by electrophotography. Alternatively, the image forming apparatus 1 may be a printer that forms a color toner image on a recording medium.

With reference to FIG. 1, a description is provided of a construction of the image forming apparatus 1.

As shown in FIG. 1, the image forming apparatus 1 includes an image forming device 2 and a fixing device 40 disposed downstream from the image forming device 2 in a sheet conveyance direction DP.

The image forming device 2 forms a toner image on a sheet P (e.g., a transfer sheet) serving as a recording medium. The image forming device 2 includes a sheet feeder 4, a registration roller pair 6, a photoconductive drum 8 serving as an image bearer, a transfer device 10, and an exposure device.

The sheet feeder 4 includes a paper tray 14 that loads a plurality of sheets P and a feed roller 16 that separates an uppermost sheet P from other sheets P loaded on the paper tray 14 and feeds the uppermost sheet P to the registration roller pair 6. The registration roller pair 6 temporarily halts the uppermost sheet P conveyed by the feed roller 16 to correct skew of the sheet P. The registration roller pair 6 conveys the sheet P to a transfer nip N formed between the photoconductive drum 8 and the transfer device 10 at a time in synchronism with rotation of the photoconductive drum 8, that is, at a time when a leading edge of a toner image formed on the photoconductive drum 8 corresponds to a predetermined position in a leading edge of the sheet P in the sheet conveyance direction DP.

The photoconductive drum 8 is surrounded by a charging roller 18, a mirror 20 constituting a part of the exposure device, a developing device 22 incorporating a developing roller 22*a*, the transfer device 10, and a cleaner 24 incorporating a cleaning blade 24*a*, which are arranged in this order in a rotation direction D8 of the photoconductive drum 8.

A light beam Lb reflected by the mirror 20 irradiates and scans the photoconductive drum 8 at an exposure position 26 thereon interposed between the charging roller 18 and the developing device 22 in the rotation direction D8 of the photoconductive drum 8.

A description is provided of an image forming operation to form a toner image on a sheet P that is performed by the image forming apparatus 1 having the construction described above.

As the photoconductive drum 8 starts rotating in the rotation direction D8, the charging roller 18 uniformly charges an outer circumferential surface of the photoconductive drum 8. The exposure device emits a light beam Lb that scans the charged outer circumferential surface of the photoconductive drum 8 at the exposure position 26 thereon according to image data sent from an external device such as a client computer, thus forming an electrostatic latent image on the photoconductive drum 8. The electrostatic latent image formed on the photoconductive drum 8 moves in accordance with rotation of the photoconductive drum 8 to an opposed position thereon disposed opposite the developing device 22 where the developing device 22 supplies toner to the electrostatic latent image on the photoconductive drum 8, visualizing the electrostatic latent image as a toner image. As the toner image formed on the photoconductive drum 8 reaches the transfer nip N, the toner image is transferred onto a sheet P conveyed from the paper tray 14 and entering the transfer nip N at a predetermined time by a transfer bias applied by the transfer device 10.

The sheet P bearing the toner image is conveyed to the fixing device 40 where a fixing belt 47 and a pressure roller 43 fix the toner image on the sheet P under heat and pressure. Thereafter, the sheet P bearing the fixed toner image is ejected onto an output tray that stacks the sheet P.

As residual toner failed to be transferred onto the sheet P at the transfer nip N and therefore remaining on the photoconductive drum 8 moves under the cleaner 24 in accordance with rotation of the photoconductive drum 8, the cleaning blade 24*a* scrapes the residual toner off the photoconductive drum 8, thus cleaning the photoconductive drum 8. Thereafter, a discharger removes residual potential on the photoconductive drum 8, rendering the photoconductive drum 8 to be ready for a next image forming operation.

A description is provided of a construction of the fixing device 40 incorporated in the image forming apparatus 1 described above.

The fixing device 40 is installed in the image forming apparatus 1 and fixes the toner image formed on the sheet P thereon.

Figure 2:
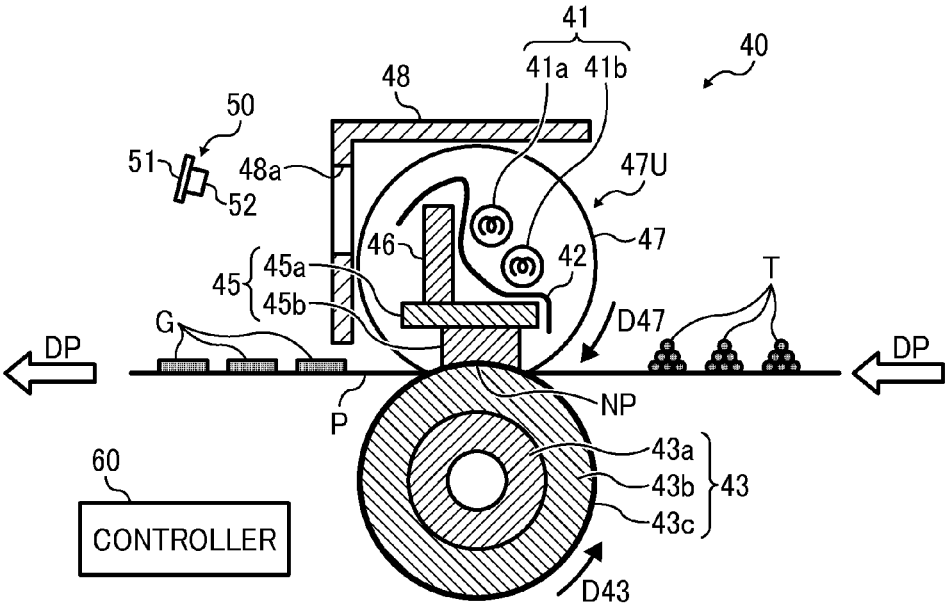
FIG. 2 is a schematic vertical sectional view of a fixing device installed in the image forming apparatus shown in FIG. 1.
Figure 3:
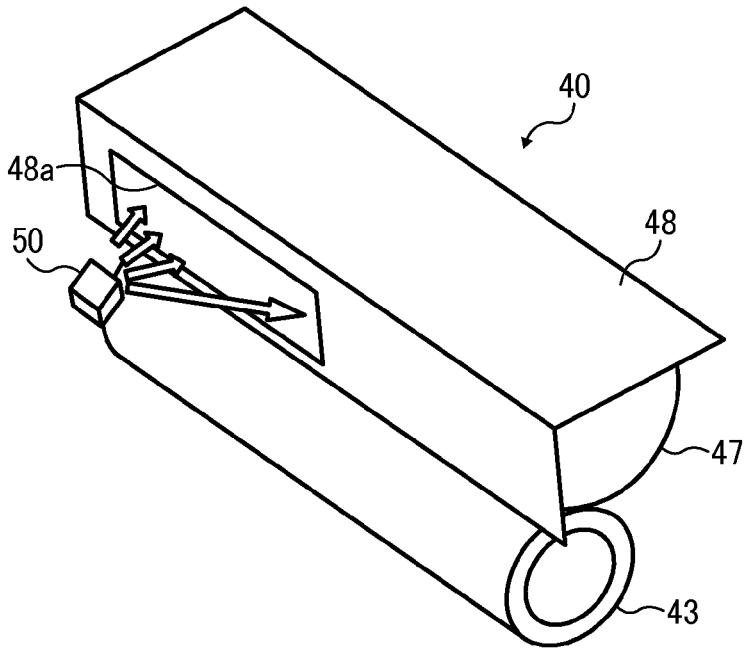
FIG. 3 is a perspective view of the fixing device shown in FIG. 2.
Figure 4A:
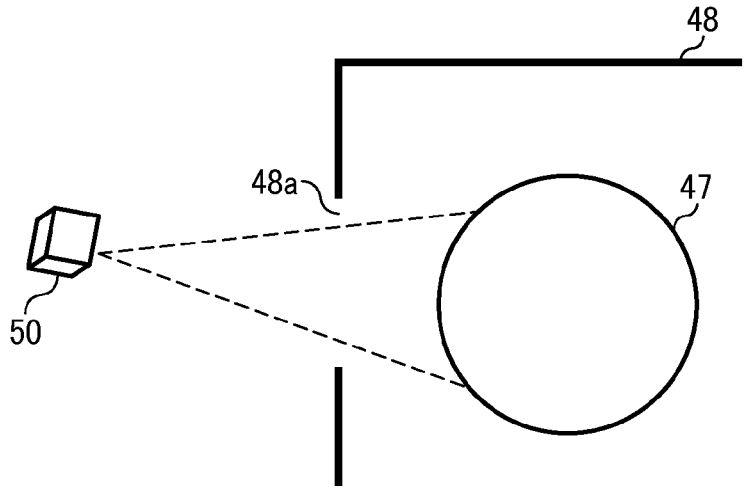
FIG. 4A is a schematic vertical sectional view of a fixing belt and a cover incorporated in the fixing device shown in FIG. 3.
Figure 4B:
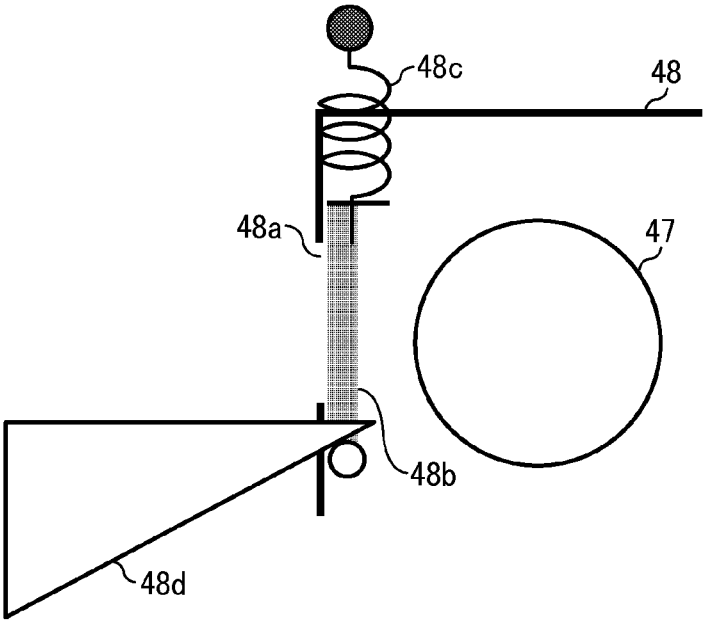
FIG. 4B is a schematic vertical sectional view of the fixing belt and the cover shown in FIG. 4A illustrating a shutter of the cover that is closed.
Figure 4C:
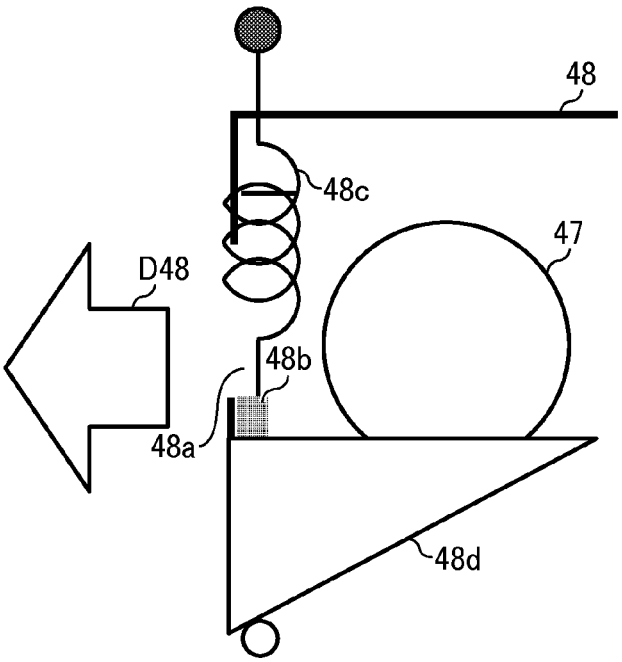
FIG. 4C is a schematic vertical sectional view of the fixing belt and the cover shown in FIG. 4A illustrating the shutter of the cover that is opened.

FIG. 2 is a vertical sectional view of the fixing device 40. FIG. 3 is a perspective view of the fixing device 40. FIG. 4A is a schematic vertical sectional view of the fixing belt 47 and a cover 48 incorporated in the fixing device 40. FIG. 4B is a schematic vertical sectional view of the fixing belt 47 and the cover 48 illustrating a shutter 48*b* of the cover 48 that is closed. FIG. 4C is a schematic vertical sectional view of the fixing belt 47 and the cover 48 illustrating the shutter 48*b* of the cover 48 that is opened.

As shown in FIGS. 2 and 3, the fixing device 40 (e.g., a fuser or a fusing unit) includes the fixing belt 47 serving as a fixing rotator or a fixing member; a heat source 41 serving as a heating device, a reflector 42, a nip formation pad 45, and a reinforcement 46 which are disposed inside a loop formed by the fixing belt 47; and the pressure roller 43 serving as a pressure rotator or a pressure member disposed outside the loop formed by the fixing belt 47. The fixing belt 47 and the components disposed inside the loop formed by the fixing belt 47, that is, the heat source 41, the reflector 42, the nip formation pad 45, and the reinforcement 46, may constitute a belt unit 47U separably coupled with the pressure roller 43. The fixing device 40 further includes the cover 48, a temperature detector 50, and a controller 60. Alternatively, the controller 60 may be located inside the image forming apparatus 1 depicted in FIG. 1.

A detailed description is now given of a construction of the heat source 41.

Figure 5:
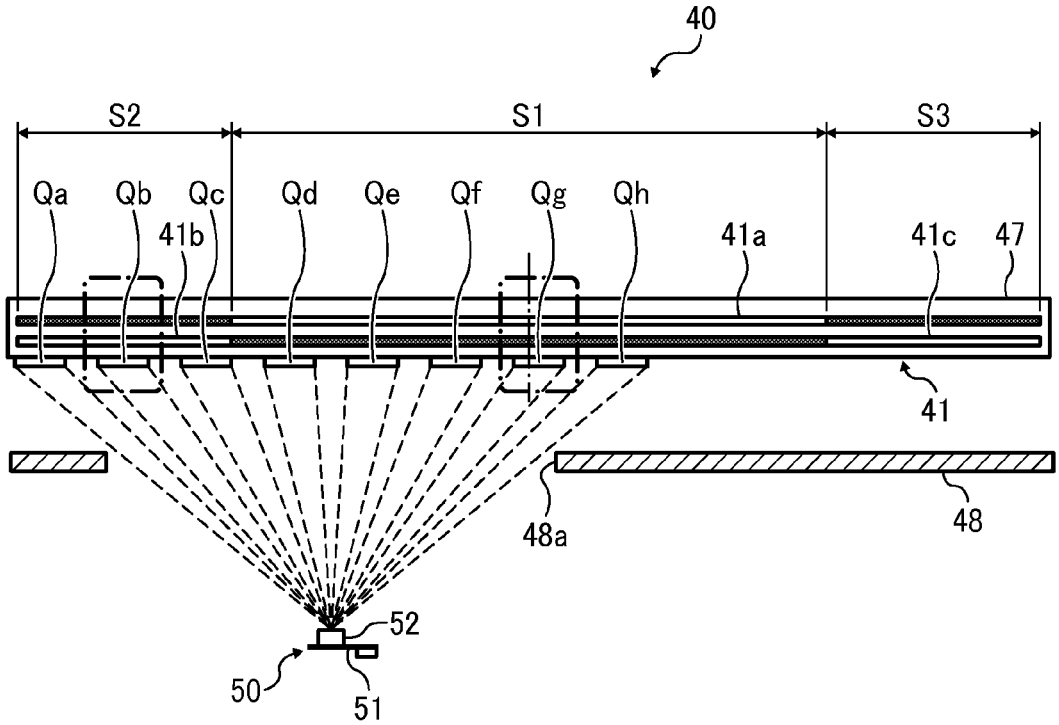
FIG. 5 is a horizontal sectional view of the fixing device shown in FIG. 3 illustrating a temperature sensor unit incorporated therein.

FIG. 5 is a horizontal sectional view of the fixing device 40. FIG. 5 illustrates a positional relation between the fixing belt 47 and the temperature detector 50. As shown in FIG. 5, the heat source 41 heats the fixing belt 47 with radiation heat without contacting the fixing belt 47. The heat source 41 includes heaters 41*a*, 41*b*, and 41*c*, each of which is a halogen heater, a carbon heater, or the like. According to this exemplary embodiment, each of the heaters 41*a*, 41*b*, and 41*c* is a halogen heater. The heater 41*a* serving as a center heater or a first heater is a bar heater disposed opposite a center heated span S1 serving as a first heated span on the fixing belt 47 in an axial direction thereof, that is, a horizontal direction in FIG. 5. The heater 41*b* serving as a lateral end heater or a second heater is a bar heater disposed opposite a lateral end heated span S2 serving as a second heated span on the fixing belt 47 in the axial direction thereof. The heater 41*c* serving as a lateral end heater or a third heater is a bar heater disposed opposite a lateral end heated span S3 serving as a third heated span on the fixing belt 47 in the axial direction thereof. The heaters 41*a*, 41*b*, and 41*c* are aligned in the axial direction of the fixing belt 47 and shifted from each other in the axial direction of the fixing belt 47. The heater 41*a* is shifted from the heaters 41*b* and 41*c* in a circumferential direction of the fixing belt 47. FIG. 5 illustrates a sectional view of the fixing belt 47 to show the position of each of the heaters 41*a*, 41*b*, and 41*c*.

The controller 60 depicted in FIG. 2 controls the heater 41*a* independently from the heaters 41*b* and 41*c* as described below. For example, the heaters 41*b* and 41*c* are electrically connected in series and under an identical control by the controller 60.

A detailed description is now given of a construction of the reflector 42.

As shown in FIG. 2, the reflector 42 reflects heat rays or light radiated from the heat source 41 to an inner circumferential surface of the fixing belt 47 effectively. The reflector 42 is made of metal having an increased reflectance such as aluminum and silver. According to this exemplary embodiment, the reflector 42 is made of a composite material constructed of a stainless steel layer, a silver layer, and a resin layer.

A detailed description is now given of a construction of the pressure roller 43.

As shown in FIG. 2, the pressure roller 43 is a pressure rotator contacting an outer circumferential surface of the fixing belt 47 and rotatable in a rotation direction D43. The pressure roller 43 has a diameter not smaller than about 20 mm and not greater than about 30 mm. The pressure roller 43 is constructed of a cored bar 43*a*, that is, a metal tube; an elastic foam layer 43*b* layered on the cored bar 43*a* and made of open cells; and a release layer 43*c* layered on the elastic foam layer 43*b*. The pressure roller 43 is pressed against the nip formation pad 45 via the fixing belt 47 to form a fixing nip NP between the fixing belt 47 and the pressure roller 43. The pressure roller 43 further includes a grip layer at each lateral end of the pressure roller 43 in an axial direction thereof disposed outboard from a conveyance span where the sheet P is conveyed over the pressure roller 43. The grip layer of the pressure roller 43 contacts the fixing belt 47 to rotate the fixing belt 47 by friction therebetween.

The elastic foam layer 43*b* is a foamed elastomer having open cells. Since the elastic foam layer 43*b* has an increased insulation, the elastic foam layer 43*b* shortens a time taken to heat the fixing nip NP to a predetermined temperature effectively. The elastic foam layer 43*b* is made of silicone rubber foam or silicone elastomer. For example, the elastic foam layer 43*b* is manufactured in a method of kneading a silicone compound with a foaming agent, a cross-linking agent, and a communication agent and treating it with foaming vulcanization. According to this exemplary embodiment, the elastic foam layer 43*b* is manufactured by such method. The elastic foam layer 43*b* made of silicone rubber foam having an expansion ratio not smaller than about 1.5 and not greater than about 3.0 achieves a decreased thermal capacity and a sufficient strength. According to this exemplary embodiment, the elastic foam layer 43*b* has an expansion ratio of about 2.0.

The release layer 43*c* is made of fluoroplastic or the like to attain heat resistance and prevent toner from adhering to the pressure roller 43. For example, the fluoroplastic may be tetrafluoroethylene-perfluoroalkylvinylether copolymer (PFA) or polytetrafluoroethylene (PTFE). The release layer 43*c* has a thickness not greater than about 0.1 mm to suppress the surface hardness of the pressure roller 43. According to this exemplary embodiment, the release layer 43*c* is made of PFA and has a thickness of about 0.03 mm.

A detailed description is now given of a construction of the nip formation pad 45.

The nip formation pad 45 presses against the pressure roller 43 via the fixing belt 47 to form the fixing nip NP between the fixing belt 47 and the pressure roller 43. The nip formation pad 45 includes a rigid portion 45*a* made of metal, an elastic portion 45*b* made of rubber, and a slide aid sheet that covers the rigid portion 45*a* and the elastic portion 45*b*. The rigid portion 45*a* is made of metal, ceramic, or the like rigid enough to endure against pressure exerted by the pressure roller 43 at the fixing nip NP. According to this exemplary embodiment, the rigid portion 45*a* is made of stainless steel. The elastic portion 45*b* has a nip face disposed opposite the pressure roller 43 and recessed along a curvature of the pressure roller 43 to form the fixing nip NP having an increased length in the sheet conveyance direction DP great enough to apply heat and pressure to the sheet P sufficiently even when the sheet P is conveyed through the fixing nip NP at high speed.

A detailed description is now given of a configuration of the reinforcement 46.

The reinforcement 46 reinforces and supports the stationary nip formation pad 45 that forms the fixing nip NP, preventing deformation and displacement of the nip formation pad 45 that may occur by pressure from the pressure roller 43. The reinforcement 46 is made of metal having an increased mechanical strength such as stainless steel and iron to attain the advantage described above. According to this exemplary embodiment, the reinforcement 46 is made of stainless steel.

A detailed description is now given of a construction of the fixing belt 47.

Figure 6:
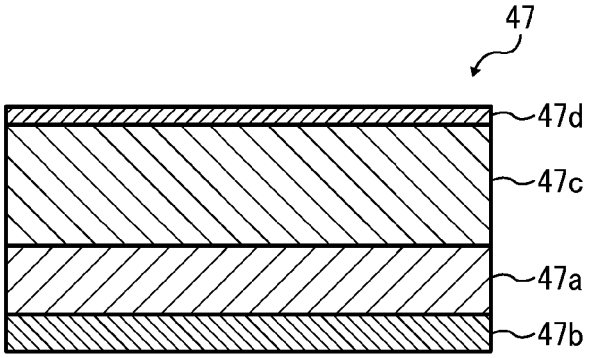
FIG. 6 is a sectional view of the fixing belt incorporated in the fixing device shown in FIG. 2.

As shown in FIG. 2, the fixing belt 47 is an endless belt rotatable in a rotation direction D47. FIG. 6 is a sectional view of the fixing belt 47. As shown in FIG. 6, the fixing belt 47 is constructed of a base layer 47*a*; a sliding layer 47*b* layered on an inner circumferential surface of the base layer 47*a*; an elastic layer 47*c* layered on an outer circumferential surface of the base layer 47*a*; and a release layer 47*d* layered on the elastic layer 47*c*. Those layers are manufactured by a general method. Alternatively, a primer layer may be interposed between the adjacent layers of the sliding layer 47*b*, the base layer 47*a*, the elastic layer 47*c*, and the release layer 47*d* as needed. Instead of the endless belt, the fixing belt 47 may be tubular.

The base layer 47*a* is configured to attain an endurance and a flexibility needed for the fixing belt 47 and a heat resistance great enough to endure use under a fixing temperature at which a toner image T is fixed on a sheet P. The elastic layer 47*c* and the release layer 47*d* are also configured to attain those advantages.

For example, the base layer 47*a* is an endless belt-shaped base constructed of a nickel layer made of nickel or an alloy of nickel and a copper layer made of copper or an alloy of copper layered on the nickel layer. The base layer 47*a* has a thickness not smaller than about 20 micrometers and not greater than about 200 micrometers to attain a thermal capacity and a mechanical strength needed for the fixing belt 47. Preferably, the base layer 47*a* has a thickness not smaller than about 30 micrometers and not greater than about 50 micrometers. The total thickness of the fixing belt 47 allows a deviation within plus and minus 10 percent with respect to a target value.

In fixing devices, like the fixing device 40, employing a quick start-up (QSU) method to shorten a start-up time to heat the downsized fixing belt 47 to the fixing temperature, the sliding layer 47*b* has a thickness not smaller than about 5 micrometers and not greater than about 30 micrometers to decrease a slide resistance between the nip formation pad 45 and the fixing belt 47 sliding thereover and enhance heating efficiency of the heat source 41 to heat the fixing belt 47 with coloring in black or the like.

The sliding layer 47*b* is made of fluoroplastic, a mixture of fluoroplastic, or a heat resistance resin dispersed with fluoroplastic. The fluoroplastic may be PTFE, PFA, tetrafluoroethylene-hexafluoropropylene copolymer (FEP), and the like. The sliding layer 47*b* has an emissivity not smaller than about 0.9 with a light beam having a wavelength in a range of from 3 micrometers to 5 micrometers in a Japanese Industrial Standards (JIS) A1423 measurement method.

The elastic layer 47*c* has a rubber hardness not smaller than about 5 degrees and not greater than about 50 degrees under JIS-A and a thickness not smaller than about 50 micrometers and not greater than about 500 micrometers to add flexibility to the outer circumferential surface of the fixing belt 47 so as to form a toner image having an even gloss. The elastic layer 47*c* is made of silicone rubber, fluoro silicone rubber, or the like to achieve heat resistance at the fixing temperature.

The release layer 47*d* covering the elastic layer 47*c* is made of fluoroplastic, a mixture of fluoroplastic, or a heat resistance resin dispersed with fluoroplastic. The fluoroplastic may be PTFE, PFA, FEP, and the like.

The release layer 47*d* made of the material described above, as it covers the elastic layer 47*c*, facilitates separation of toner from the fixing belt 47 without using silicone oil or the like and prevents paper dust from adhering to the fixing belt 47. Thus, the fixing belt 47 attains an oilless configuration.

However, the above-described resins facilitating separation of toner from the fixing belt 47 do not have an elasticity that rubber has. Accordingly, if the release layer 47*d* having an increased thickness is layered on the elastic layer 47*c*, the release layer 47*d* may degrade flexibility of the outer circumferential surface of the fixing belt 47, resulting in variation in gloss of the toner image formed on the sheet P.

In order to attain both separability of toner from the fixing belt 47 and flexibility of the fixing belt 47 as well as durability of the fixing belt 47, the release layer 47*d* has a thickness not smaller than about 4 micrometers and not greater than about 50 micrometers, preferably, a thickness not smaller than about 5 micrometers and not greater than about 20 micrometers. According to this exemplary embodiment, the release layer 47*d* has a thickness of about 7 micrometers.

A detailed description is now given of a construction of the cover 48.

As shown in FIG. 2, the cover 48, made of synthetic resin, metal, or the like, for example, covers the fixing belt 47. According to this exemplary embodiment, as one example, the cover 48 is constructed of two rectangular plates combined into an L-shape in cross-section. As shown in FIG. 3, the cover 48 includes a rectangular aperture 48*a* that exposes a part of the outer circumferential surface of the fixing belt 47.

As shown in FIGS. 4B and 4C, the cover 48 further includes the shutter 48*b* serving as a block or a shield placed over the aperture 48*a*. When the cover 48 is installed inside the image forming apparatus 1 depicted in FIG. 1, the shutter 48*b* opens to expose the aperture 48*a* as shown in FIG. 4C. Conversely, when the cover 48 is removed from the image forming apparatus 1, the shutter 48*b* closes to be placed over the aperture 48*a* as shown in FIG. 4B. For example, as shown in FIG. 4B, as the cover 48 is detached from the image forming apparatus 1, a spring 48*c* biases the shutter 48*b* to close the shutter 48*b* so that the shutter 48*b* blocks the aperture 48*a*. Conversely, as shown in FIG. 4C, as the cover 48 is attached to the image forming apparatus 1 in a direction D48, a guide 48*d* mounted in the image forming apparatus 1 and contacting the shutter 48*b* moves the shutter 48*b* against a bias from the spring 48*c* to open the shutter 48*b* so that the aperture 48*a* is exposed. Accordingly, the fixing belt 47 is exposed to the temperature detector 50 though the aperture 48*a* as shown in FIG. 4A.

As shown in FIG. 2, as the fixing belt 47 rotates in accordance with rotation of the pressure roller 43 contacting the outer circumferential surface of the fixing belt 47, the fixing belt 47 heated by the heat source 41 heats the sheet P conveyed through the fixing nip NP. Accordingly, as shown in FIG. 6, the fixing belt 47 includes the base layer 47*a* made of metal that enhances the mechanical strength of the fixing belt 47.

The fixing belt 47 having the metallic base layer 47*a* attains an increased thermal conductivity to conduct heat in a thickness direction of the fixing belt 47. Accordingly, as the center conveyance span on the fixing belt 47 in the axial direction thereof over which the sheet P is conveyed is heated to a predetermined target temperature, each lateral end span on the fixing belt 47 in the axial direction thereof over which the sheet P is not conveyed may overheat because the sheet P does not draw heat from each lateral end span on the fixing belt 47.

Figure 7:
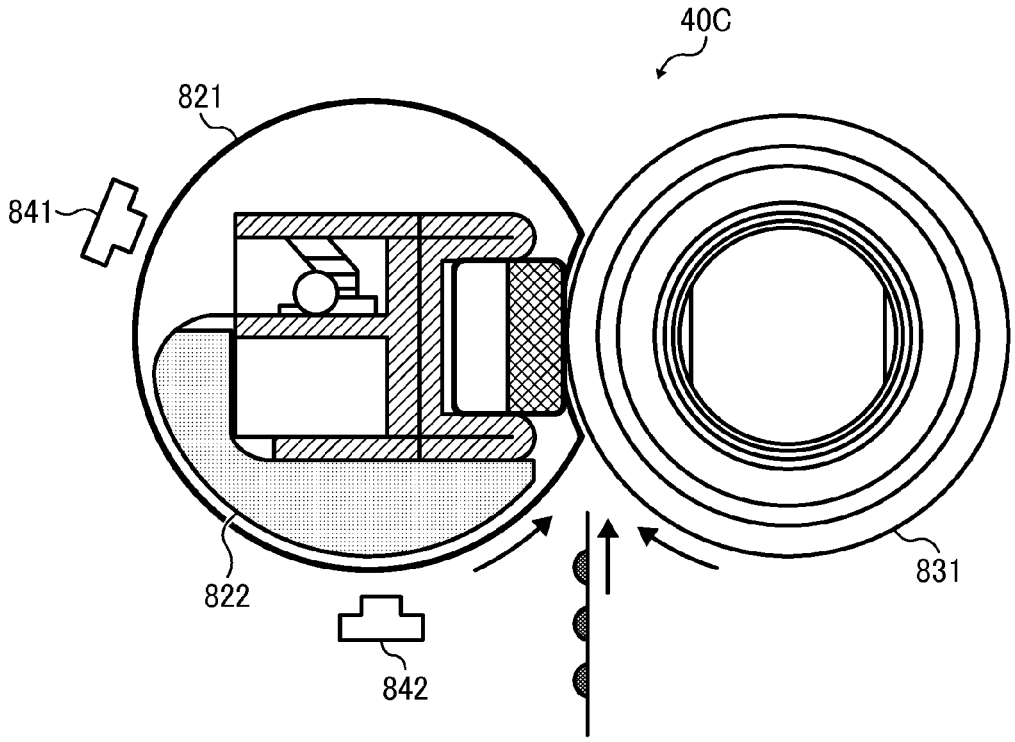
FIG. 7 is a schematic vertical sectional view of a comparative fixing device.
Figure 8:
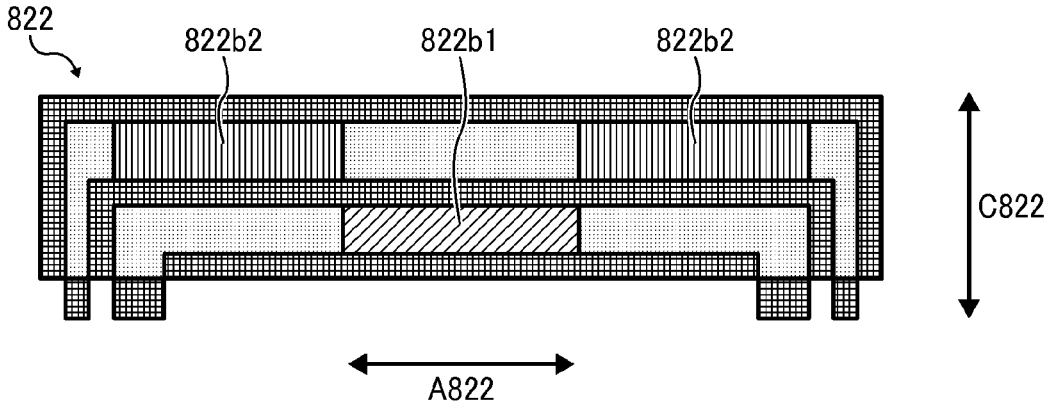
FIG. 8 is a plan view of a laminated heater incorporated in the comparative fixing device shown in FIG. 7.

To address this circumstance, a comparative fixing device 40C has a construction shown in FIG. 7. FIG. 7 is a schematic vertical sectional view of the comparative fixing device 40C. As shown in FIG. 7, the comparative fixing device 40C includes a fixing belt 821, a pressure roller 831 pressed against the fixing belt 821, and a laminated heater 822 disposed inside a loop formed by the fixing belt 821. FIG. 8 is a plan view of the laminated heater 822. As shown in FIG. 8, the laminated heater 822 includes a principal plane divided into three spans in an axial direction A822 thereof and two spans in a circumferential direction C822 thereof to produce six regions. A resistance heat generation layer 822*b*1 is situated at a lower center of the laminated heater 822 in FIG. 8. A resistance heat generation layer 822*b*2 is situated at each upper lateral end of the laminated heater 822 in FIG. 8. The resistance heat generation layers 822*b*1 and 822*b*2 are actuated separately to heat the fixing belt 821 to the target temperature evenly throughout the entire span in an axial direction of the fixing belt 821.

However, as shown in FIG. 7, a plurality of temperature sensors 841 and 842 is needed to detect the temperature of the fixing belt 821 in a center span on the fixing belt 821 in the axial direction thereof that is heated by the resistance heat generation layer 822*b*1 and each lateral end span on the fixing belt 821 in the axial direction thereof that is heated by the resistance heat generation layer 822*b*2. Accordingly, the plurality of temperature sensors 841 and 842 corresponding to the plurality of resistance heat generation layers 822*b*1 and 822*b*2 separately actuated may increase manufacturing costs.

A detailed description is now given of a construction of the temperature detector 50.

Figure 9:
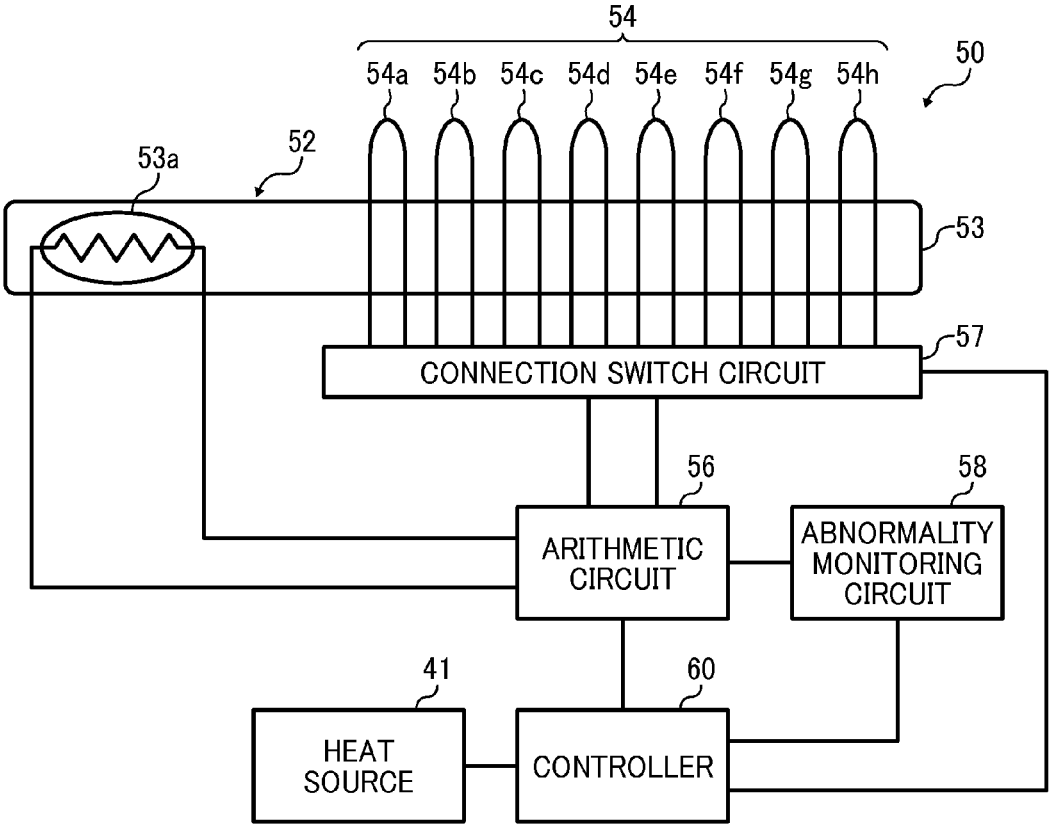
FIG. 9 is a block diagram of a temperature detector incorporated in the fixing device shown in FIG. 2.

FIG. 9 is a block diagram of the temperature detector 50. FIG. 9 illustrates a connective relation among a temperature sensor unit 52, an arithmetic circuit 56, an abnormality monitoring circuit 58, and the controller 60. As shown in FIGS. 2 and 9, the temperature detector 50 includes a circuit board 51, the single temperature sensor unit 52, the arithmetic circuit 56 serving as a calculator, a connection switch circuit 57 serving as a connection switch, and the abnormality monitoring circuit 58 serving as an abnormality monitor.

As shown in FIG. 2, the temperature detector 50 is separably installed in the fixing device 40 such that the temperature detector 50 is attachable to and detachable from components of the fixing device 40 other than the temperature detector 50. For example, the temperature detector 50 is separable from the heat source 41, the pressure roller 43, the fixing belt 47, the cover 48, and the like. The temperature detector 50 is mounted on a structure or the like such as a frame of the image forming apparatus 1.

A detailed description is now given of a configuration of the circuit board 51.

The circuit board 51 is a printed circuited board mounting electronic components constituting the temperature sensor unit 52, the arithmetic circuit 56, the connection switch circuit 57, and the abnormality monitoring circuit 58 depicted in FIG. 9.

A detailed description is now given of a configuration of the temperature sensor unit 52.

As shown in FIG. 9, the temperature sensor unit 52 includes a thermopile array 54 constructed of a plurality of thermopiles 54*a* to 54*h* serving as a plurality of temperature detection elements. The temperature sensor unit 52 includes a reference contact 53 incorporating a reference temperature detector 53*a* and the thermopile array 54 incorporating the eight thermopiles 54*a* to 54*h* aligned in a predetermined direction. As shown in FIG. 2, the temperature sensor unit 52 is disposed opposite the fixing belt 47 such that the plurality of thermopiles 54*a* to 54*h* of the thermopile array 54 is disposed opposite the outer circumferential surface of the fixing belt 47 through the aperture 48*a* of the cover 48 and the plurality of thermopiles 54*a* to 54*h* is aligned in the axial direction of the fixing belt 47.

As shown in FIG. 5, the eight thermopiles 54*a* to 54*h* detect the temperature of the fixing belt 47 in eight detection spans Qa to Qh aligned on the outer circumferential surface of the fixing belt 47 in the axial direction thereof, respectively, without contacting the fixing belt 47. According to this exemplary embodiment, the eight thermopiles 54*a* to 54*h* correspond to the eight detection spans Qa to Qh on the fixing belt 47, respectively. As shown in FIGS. 5 and 9, the thermopile 54*g* serving as a first temperature detection element inboard from and adjacent to the rightmost thermopile 54*h* situated at one end of the thermopile array 54 in the axial direction of the fixing belt 47 detects the temperature of a part of the center heated span S1 on the outer circumferential surface of the fixing belt 47 in the axial direction thereof, specifically, a center of the center heated span S1 on the outer circumferential surface of the fixing belt 47 that is heated by the heater 41*a*. Conversely, the thermopile 54*b* serving as a second temperature detection element inboard from and adjacent to the leftmost thermopile 54*a* situated at another end of the thermopile array 54 in the axial direction of the fixing belt 47 detects the temperature of a part of the lateral end heated span S2 on the outer circumferential surface of the fixing belt 47 in the axial direction thereof, specifically, a center of the lateral end heated span S2 on the outer circumferential surface of the fixing belt 47 that is heated by the heater 41*b*.

A detailed description is now given of a configuration of the arithmetic circuit 56.

The arithmetic circuit 56 is constructed of an electronic component or the like such as an operational amplifier, for example. As shown in FIG. 9, the arithmetic circuit 56 is connected to one of the thermopiles 54*a* to 54*h* through the connection switch circuit 57 that is selected by the connection switch circuit 57 described below. The arithmetic circuit 56, operatively connectable to at least one of the thermopiles 54*a* to 54*h* and the reference temperature detector 53*a*, calculates output of the selected one of the thermopiles 54*a* to 54*h* and output of the reference temperature detector 53*a* and outputs a signal determined based on the temperature of a part of the outer circumferential surface of the fixing belt 47 that corresponds to the selected one of the thermopiles 54*a* to 54*h* to the controller 60.

A detailed description is now given of a configuration of the connection switch circuit 57.

The connection switch circuit 57 is constructed of an electronic component or the like such as an analog switch, for example. The connection switch circuit 57 connects one of the thermopiles 54*a* to 54*h* that is specified by a control signal from the controller 60 described below to the arithmetic circuit 56.

A detailed description is now given of a configuration of the abnormality monitoring circuit 58.

The abnormality monitoring circuit 58 is constructed of an electronic component or the like such as an operational amplifier, for example. The abnormality monitoring circuit 58, operatively connected to the arithmetic circuit 56 and the controller 60, compares the signal output by the arithmetic circuit 56 with a predetermined reference voltage signal corresponding to an allowable upper limit temperature, that is, one example of an upper limit temperature, of the outer circumferential surface of the fixing belt 47. If the abnormality monitoring circuit 58 determines that the temperature of the outer circumferential surface of the fixing belt 47 exceeds the allowable upper limit temperature based on a comparison result, the abnormality monitoring circuit 58 outputs an abnormality signal to the controller 60.

A detailed description is now given of a configuration of the controller 60.

The controller 60 (e.g., a processor) is constructed of an electronic component including a micro computer incorporating a central processing unit (CPU), a read-only memory (ROM), a random-access memory (RAM), and the like, for example. The controller 60 is operatively connected to the heaters 41*a*, 41*b*, and 41*c* of the heat source 41 (e.g., a power supply that supplies power to the heaters 41*a*, 41*b*, and 41*c*), the arithmetic circuit 56, the connection switch circuit 57, and the abnormality monitoring circuit 58.

A description is provided of a fixing operation performed by the fixing device 40.

During the fixing operation of the fixing device 40, the controller 60 supplies power to the heaters 41*a*, 41*b*, and 41*c* of the heat source 41 to heat the fixing belt 47. Simultaneously, the controller 60 controls the connection switch circuit 57 to switch connection between the thermopiles 54*a* to 54*h* and the arithmetic circuit 56, detecting the temperature of a selected part on the outer circumferential surface of the fixing belt 47 based on the signal output by the arithmetic circuit 56.

For example, the controller 60 controls the connection switch circuit 57 to connect the thermopiles 54*g* and 54*b* to the arithmetic circuit 56 alternately, detecting the temperature of the detection spans Qg and Qb depicted in FIG. 5 on the outer circumferential surface of the fixing belt 47. Thus, the controller 60 detects the temperature of the fixing belt 47 in the center heated span S1 heated by the heater 41*a* and the lateral end heated span S2 heated by the heater 41*b* simply.

Alternatively, the controller 60 may control the connection switch circuit 57 to connect all the thermopiles 54*a* to 54*h* to the arithmetic circuit 56 in order, detecting the temperature of the detection spans Qa to Qh on the outer circumferential surface of the fixing belt 47. Thus, the controller 60 detects the temperature of the fixing belt 47 in the center heated span S1 heated by the heater 41*a* and the lateral end heated span S2 heated by the heater 41*b* more precisely.

The controller 60 controls power supply to each of the heaters 41*a*, 41*b*, and 41*c* by feedback of the detected temperature of the fixing belt 47, adjusting an amount of heat conducted to the fixing belt 47 so that the fixing belt 47 is heated to a predetermined target temperature.

When the controller 60 receives the abnormality signal output by the abnormality monitoring circuit 58, the controller 60 breaks power supply to the heaters 41*a*, 41*b*, and 41*c*. Thus, the controller 60 serves as a breaker.

A biasing mechanism biases the pressure roller 43 against the nip formation pad 45 via the fixing belt 47 to form the fixing nip NP between the fixing belt 47 and the pressure roller 43 as shown in FIG. 2. A driver starts driving and rotating the pressure roller 43. Accordingly, the pressure roller 43 drives and rotates the fixing belt 47 by friction therebetween.

When the temperature of the outer circumferential surface of the fixing belt 47 reaches the predetermined target temperature, the fixing belt 47 and the pressure roller 43 apply heat and pressure to a sheet P bearing an unfixed toner image T conveyed through the fixing nip NP, melting and fixing the toner image T on the sheet P as a fixed toner image G.

While the temperature detector 50 is attached to the structure of the image forming apparatus 1, the removable components of the fixing device 40 other than the temperature detector 50 are removed from the image forming apparatus 1. Thereafter, new components of the fixing device 40 replaced with the removed components are installed in the image forming apparatus 1 and coupled with the remaining temperature detector 50, thus constituting the refreshed fixing device 40. As the cover 48 is removed from the image forming apparatus 1 together with the removable components of the fixing device 40, the shutter 48*b* blocks the aperture 48*a* as shown in FIG. 4B.

A description is provided of advantages of the fixing device 40 described above.

As shown in FIG. 2, the fixing device 40 includes the endless fixing belt 47; the pressure roller 43 pressed against the nip formation pad 45 via the fixing belt 47; and the heat source 41 that heats the fixing belt 47. As a sheet P bearing an unfixed toner image T is conveyed through the fixing nip NP formed between the heated fixing belt 47 and the pressure roller 43, the fixing belt 47 and the pressure roller 43 melt and fix the toner image T on the sheet P under heat and pressure as a fixed toner image G. As shown in FIG. 9, the fixing device 40 further includes the temperature sensor unit 52 incorporating the thermopile array 54 constructed of the plurality of thermopiles 54*a* to 54*h* that detects the temperature of the outer circumferential surface of the fixing belt 47 without contacting the fixing belt 47. As shown in FIG. 5, the heat source 41 includes the plurality of heaters 41*a*, 41*b*, and 41*c* shifted from each other in the axial direction of the fixing belt 47. The plurality of thermopiles 54*a* to 54*h* corresponds to the plurality of detection spans Qa to Qh on the outer circumferential surface of the fixing belt 47 heated by the plurality of heaters 41*a*, 41*b*, and 41*c*, respectively.

The heat source 41 includes the three heaters 41*a*, 41*b*, and 41*c*. The single heater 41*a* is disposed opposite the center heated span S1 on the fixing belt 47 in the axial direction thereof. The heaters 41*b* and 41*c*, that is, a pair of heaters, are disposed opposite the lateral end heated spans S2 and S3 on the fixing belt 47 in the axial direction thereof, respectively. The pair of heaters 41*b* and 41*c* is under the identical control by the controller 60. One of the plurality of thermopiles 54*a* to 54*h*, that is, the thermopile 54*g*, corresponds to one of the plurality of detection spans Qa to Qh, that is, the detection span Qg, on the outer circumferential surface of the fixing belt 47 that is heated by the heater 41*a*. Another one of the plurality of thermopiles 54*a* to 54*h*, that is, the thermopile 54*b*, corresponds to another one of the plurality of detection spans Qa to Qh, that is, the detection span Qb, on the outer circumferential surface of the fixing belt 47 that is heated by the heater 41*b*.

The temperature detector 50 incorporating the temperature sensor unit 52 is detachable or separable from the fixing belt 47, the pressure roller 43, and the heat source 41.

As shown in FIG. 3, the fixing device 40 further includes the cover 48 detachable or separable from the temperature detector 50. The cover 48 covers the fixing belt 47 and includes the aperture 48*a* that exposes a part of the outer circumferential surface of the fixing belt 47. As shown in FIG. 2, the temperature sensor unit 52 of the temperature detector 50 is situated outside the cover 48. That is, the temperature sensor unit 52 is disposed opposite the fixing belt 47 via the cover 48. Thus, the temperature sensor unit 52 detects the temperature of the outer circumferential surface of the fixing belt 47 through the aperture 48*a* of the cover 48. As shown in FIG. 4B, the cover 48 includes the shutter 48*b* that blocks the aperture 48*a* as the cover 48, together with the fixing belt 47, is detached from the temperature detector 50.

As shown in FIG. 9, the fixing device 40 further includes the single arithmetic circuit 56 that performs calculation of output of the thermopile array 54 and the connection switch circuit 57 that switches connection to connect the arithmetic circuit 56 to one of the thermopiles 54*a* to 54*h* selected.

The fixing device 40 further includes the single abnormality monitoring circuit 58 that detects an abnormality that at least one of temperatures detected by the thermopiles 54*a* to 54*h* exceeds the predetermined allowable upper limit temperature based on the calculation by the arithmetic circuit 56, that is, a calculation result of the arithmetic circuit 56. The controller 60 breaks power supply to at least one of the heaters 41*a*, 44*b*, and 41*c* when the abnormality monitoring circuit 58 detects the abnormality that the at least one of the temperatures detected by the thermopiles 54*a* to 54*h* exceeds the predetermined allowable upper limit temperature.

As shown in FIG. 5, the heat source 41 that heats the fixing belt 47 includes the plurality of heaters 41*a*, 41*b*, and 41*c* shifted from each other in the axial direction of the fixing belt 47, that is, the first heater, the second heater, and the third heater disposed opposite the first heated span (e.g., the center heated span S1), the second heated span (e.g., the lateral end heated span S2), and the third heated span (e.g., the lateral end heated span S3), respectively. The thermopiles 54*a* to 54*h* of the thermopile array 54 of the temperature sensor unit 52 correspond to the detection spans Qa to Qh on the outer circumferential surface of the fixing belt 47 that are heated by the heaters 41*a*, 41*b*, and 41*c*, respectively. Accordingly, the plurality of thermopiles 54*a* to 54*h* of the single temperature sensor unit 52 detects the temperature of the plurality of detection spans Qa to Qh on the outer circumferential surface of the fixing belt 47 that is heated by the plurality of heaters 41*a*, 41*b*, and 41*c*, respectively. Consequently, the fixing device 40 reduces the number of temperature sensors that detect the temperature of the outer circumferential surface of the fixing belt 47.

The heat source 41 includes the three heaters 41*a*, 41*b*, and 41*c*. The single heater 41*a* is disposed opposite the center heated span S1 on the fixing belt 47 in the axial direction thereof. The pair of heaters 41*b* and 41*c* is disposed opposite both lateral end heated spans S2 and S3 on the fixing belt 47 in the axial direction thereof, respectively. The pair of heaters 41*b* and 41*c* is under the identical control by the controller 60. One of the plurality of thermopiles 54*a* to 54*h*, that is, the thermopile 54*g*, corresponds to one of the plurality of detection spans Qa to Qh, that is, the detection span Qg, on the outer circumferential surface of the fixing belt 47 that is heated by the heater 41*a*. Another one of the plurality of thermopiles 54*a* to 54*h*, that is, the thermopile 54*b*, corresponds to another one of the plurality of detection spans Qa to Qh, that is, the detection span Qb, on the outer circumferential surface of the fixing belt 47 that is heated by the heater 41*b*. Thus, the temperature detector 50 detects a first temperature of the fixing belt 47 in the detection span Qg heated by the heater 41*a* and a second temperature of the fixing belt 47 in the detection span Qb heated by the heater 41*b* based on output from the thermopiles 54*g* and 54*b*, respectively. Additionally, since the heaters 41*b* and 41*c* are under the identical control by the controller 60, the second temperature of the detection span Qb on the fixing belt 47 that is heated by the heater 41*b* is assumed identical to the temperature of a detection span on the fixing belt 47 that is heated by the heater 41*c*. Accordingly, the controller 60 performs a simple control of the heaters 41*a*, 41*b*, and 41*c* based on the detected first and second temperatures of the two detection spans Qg and Qb, respectively, on the outer circumferential surface of the fixing belt 47.

The temperature detector 50 incorporating the temperature sensor unit 52 is detachable or separable from the fixing belt 47, the pressure roller 43, and the heat source 41. Accordingly, if the fixing device 40 is installed in the image forming apparatus 1, while the temperature detector 50 remains inside the image forming apparatus 1, the fixing belt 47, the pressure roller 43, and the heat source 41 are removed from the image forming apparatus 1. Thereafter, the new, fixing belt 47, pressure roller 43, and heat source 41 are installed in the image forming apparatus 1 and combined with the remaining temperature detector 50, thus constituting the refreshed fixing device 40. Hence, even if the fixing belt 47 or the like is replaced with new one due to a failure or the like of the fixing belt 47, the temperature detector 50 is immune from replacement, reducing replacement costs.

As shown in FIG. 3, the fixing device 40 further includes the cover 48 detachable from the temperature detector 50. The cover 48 covers the fixing belt 47 and includes the aperture 48*a* that exposes a part of the outer circumferential surface of the fixing belt 47. As shown in FIG. 2, the temperature sensor unit 52 of the temperature detector 50 is situated outside the cover 48. That is, the temperature sensor unit 52 is disposed opposite the fixing belt 47 via the cover 48. Thus, the temperature sensor unit 52 detects the temperature of the outer circumferential surface of the fixing belt 47 through the aperture 48*a* of the cover 48.

As shown in FIG. 4B, the cover 48 includes the shutter 48*b* that blocks the aperture 48*a* as the cover 48, together with the fixing belt 47, is detached from the temperature detector 50. If the aperture 48*a* is open when a service engineer or the like removes the fixing belt 47 and the cover 48 from the image forming apparatus 1, the service engineer may touch the fixing belt 47 heated to a high temperature. To address this circumstance, the shutter 48*b* blocks the aperture 48*a* to prevent the service engineer from touching the fixing belt 47. Accordingly, the service engineer removes the fixing belt 47 from the image forming apparatus 1 safely.

As shown in FIG. 9, the fixing device 40 further includes the single arithmetic circuit 56 that performs calculation of output of the thermopile array 54 and the connection switch circuit 57 that switches connection to connect the arithmetic circuit 56 to one of the thermopiles 54*a* to 54*h* selected. Accordingly, it is not necessary to provide a plurality of arithmetic circuits 56 that corresponds to the plurality of thermopiles 54*a* to 54*h*, respectively, simplifying a circuit configuration of the temperature detector 50 and reducing manufacturing costs.

The fixing device 40 further includes the single abnormality monitoring circuit 58 that detects an abnormality that at least one of temperatures detected by the thermopiles 54*a* to 54*h* exceeds the predetermined allowable upper limit temperature based on the calculation by the arithmetic circuit 56, that is, a calculation result of the arithmetic circuit 56. The controller 60 breaks power supply to at least one of the heaters 41*a*, 44*b*, and 41*c* when the abnormality monitoring circuit 58 detects the abnormality that the at least one of the temperatures detected by the thermopiles 54*a* to 54*h* exceeds the predetermined allowable upper limit temperature. Accordingly, when the temperature of the outer circumferential surface of the fixing belt 47 exceeds the predetermined allowable upper limit temperature, the controller 60 interrupts heating of the fixing belt 47 by the heaters 41*a*, 41*b*, and 41*c*, enhancing safety. Since the temperature detector 50 incorporates the single arithmetic circuit 56, the single abnormality monitoring circuit 58 corresponds to the single arithmetic circuit 56, simplifying the circuit configuration of the temperature detector 50 compared to a configuration incorporating a plurality of arithmetic circuits 56 and reducing manufacturing costs.

As shown in FIG. 5, the temperature sensor unit 52 detects the temperature of the outer circumferential surface of the fixing belt 47 in a substantially half span defined by the detection spans Qa to Qh on the fixing belt 47 in the axial direction thereof. However, the configuration of the temperature sensor unit 52 is not limited to the configuration shown in FIG. 5. For example, the temperature sensor unit 52 may detect the temperature of the outer circumferential surface of the fixing belt 47 in a substantially entire span on the fixing belt 47 in the axial direction thereof as shown in FIG. 10.

Figure 10:
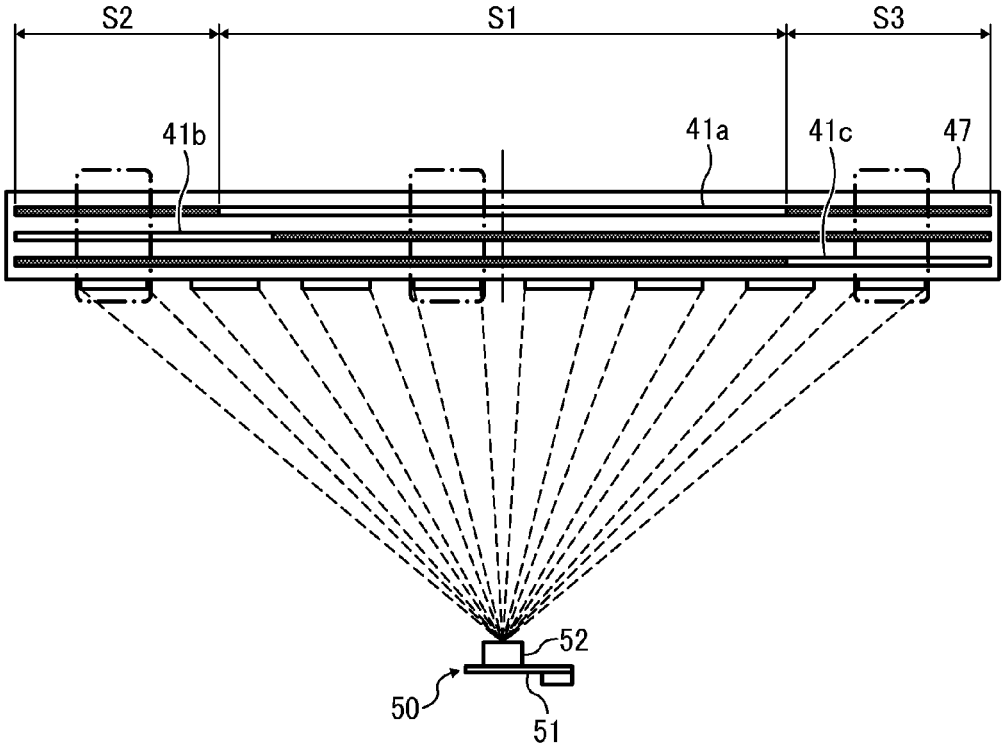
FIG. 10 is a horizontal sectional view of the fixing belt and the temperature sensor unit that detects the temperature of the fixing belt in a substantially entire span on the fixing belt in an axial direction thereof as a variation of the temperature sensor unit shown in FIG. 5.

FIG. 10 is a horizontal sectional view of the temperature detector 50, the fixing belt 47, and the heaters 41*a*, 41*b*, and 41*c*. FIG. 10 illustrates a sectional view of the fixing belt 47 to show the position of each of the heaters 41*a*, 41*b*, and 41*c*. FIG. 10 illustrates the temperature sensor unit 52 that detects the temperature of the outer circumferential surface of the fixing belt 47 in the substantially entire span on the fixing belt 47 in the axial direction thereof. The heaters 41*a*, 41*b*, and 41*c* are shifted from each other in the axial direction and the circumferential direction of the fixing belt 47 and controlled independently. The single temperature sensor unit 52 detects the temperature of the fixing belt 47 in the center heated span S1, the lateral end heated span S2, and the lateral end heated span S3 on the fixing belt 47 that are heated by the heaters 41*a*, 41*b*, and 41*c*, respectively. However, the temperature sensor unit 52 may be isolated from the fixing belt 47 with an increased interval therebetween.

Figure 11A:
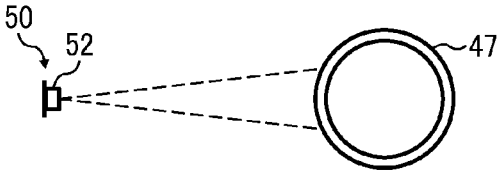
FIG. 11A is a schematic vertical sectional view of the fixing belt and the temperature sensor unit shown in FIG. 10 isolated from the fixing belt with a decreased interval therebetween.
Figure 11B:
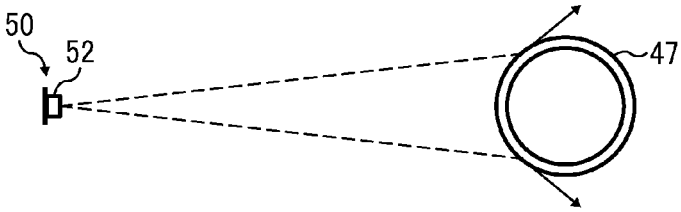
FIG. 11B is a schematic vertical sectional view of the fixing belt and the temperature sensor unit shown in FIG. 10 isolated from the fixing belt with an increased interval therebetween.

FIG. 11A is a schematic vertical sectional view of the fixing belt 47 and the temperature sensor unit 52 isolated from the fixing belt 47 with a decreased interval therebetween, illustrating a decreased detection span on the fixing belt 47 in the circumferential direction thereof. FIG. 11B is a schematic vertical sectional view of the fixing belt 47 and the temperature sensor unit 52 isolated from the fixing belt 47 with an increased interval therebetween, illustrating an increased detection span on the fixing belt 47 in the circumferential direction thereof.

As shown in FIGS. 11A and 11B, the thermopile array 54 of the temperature sensor unit 52 shown in FIG. 11B detects the temperature of the fixing belt 47 also in the increased detection span on the fixing belt 47 in the circumferential direction thereof compared to the thermopile array 54 of the temperature sensor unit 52 shown in FIG. 11A. Accordingly, the temperature sensor unit 52 may detect the temperature of an outside of the fixing belt 47, that is, infrared rays reflected by the outer circumferential surface of the fixing belt 47. Hence, the temperature sensor unit 52 shown in FIG. 11B is suitable for a configuration that does not require an increased accuracy in control of the temperature of the fixing belt 47.

According to the exemplary embodiments described above, the temperature detector 50 is installed in the image forming apparatus 1 such that the temperature detector 50 is separable from the components of the fixing device 40 other than the temperature detector 50 to remain inside the image forming apparatus 1. However, the configuration of the temperature detector 50 is not limited to that according to the exemplary embodiments described above. For example, the entire fixing device 40 including the temperature detector 50 may be detachable from the image forming apparatus 1.

According to the exemplary embodiments described above, as shown in FIG. 4B, the shutter 48*b* is placed over the aperture 48*a* of the cover 48. However, the construction of the cover 48 is not limited to that according to the exemplary embodiments described above. For example, the cover 48 may not incorporate the shutter 48*b*. Yet alternatively, the fixing device 40 may not incorporate the cover 48.

Figure 12:
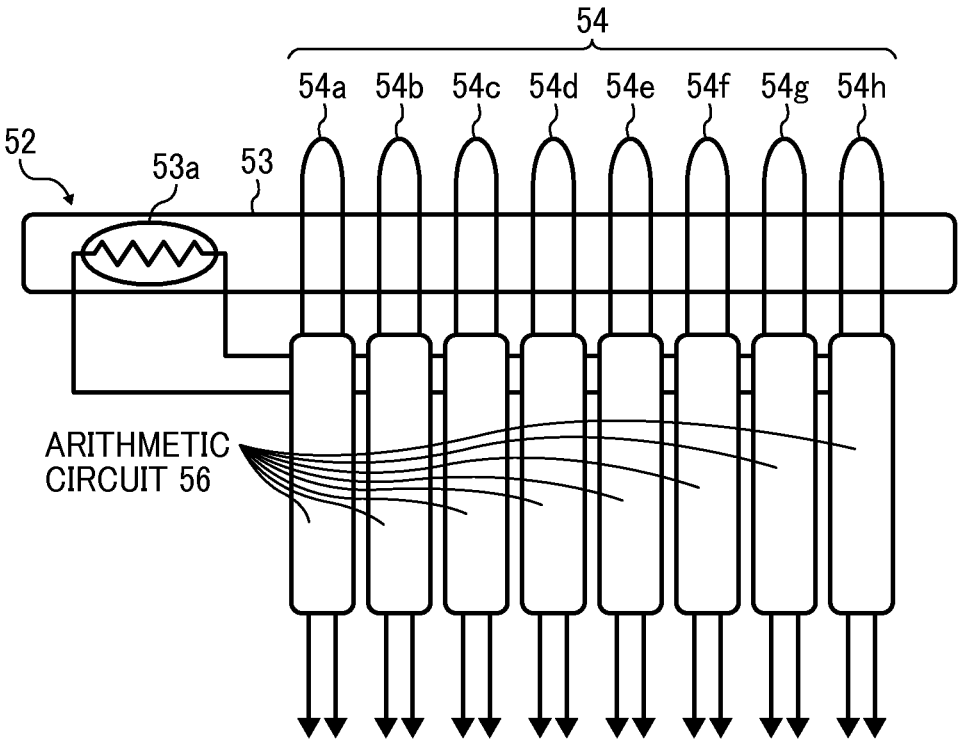
FIG. 12 is a block diagram showing a plurality of arithmetic circuits corresponding to a plurality of thermopiles, respectively, as a variation of the temperature detector shown in FIG. 9.

According to the exemplary embodiments described above, as shown in FIG. 9, the connection switch circuit 57 connects one of the thermopiles 54*a* to 54*h* to the arithmetic circuit 56. However, the configuration of the connection switch circuit 57 is not limited to that according to the exemplary embodiments described above. For example, the temperature detector 50 may not incorporate the connection switch circuit 57 and a plurality of arithmetic circuits 56 may be connected to the plurality of thermopiles 54*a* to 54*h*, respectively, as shown in FIG. 12. FIG. 12 is a block diagram showing the plurality of arithmetic circuits 56 corresponding to the plurality of thermopiles 54*a* to 54*h*, respectively. FIG. 12 illustrates a variation of the connective relation between the temperature sensor unit 52 and the arithmetic circuit 56.

According to the exemplary embodiments described above, as shown in FIG. 9, the temperature detector 50 of the fixing device 40 incorporates the abnormality monitoring circuit 58. However, the configuration of the abnormality monitoring circuit 58 is not limited to that according to the exemplary embodiments described above. For example, if the image forming apparatus 1 incorporates a mechanism that monitors abnormality, the fixing device 40 may not incorporate the abnormality monitoring circuit 58.

As shown in FIG. 1, the image forming apparatus 1 includes the image forming device 2 that forms a toner image on a sheet P and the fixing device 40 that fixes the toner image on the sheet P. As shown in FIGS. 5, 9, and 10, the fixing device 40 incorporates the single temperature sensor unit 52 including the plurality of thermopiles 54*a* to 54*h* that detects the temperature of the plurality of detection spans Qa to Qh on the outer circumferential surface of the fixing belt 47 that is heated by the plurality of heaters 41*a*, 41*b*, and 41*c*. Accordingly, the fixing device 40 reduces the number of temperature sensors that detect the temperature of the outer circumferential surface of the fixing belt 47.

As shown in FIG. 2, the fixing device 40 includes a tubular or endless belt shaped fixing rotator (e.g., the fixing belt 47); a pressure rotator (e.g., the pressure roller 43) pressed against the fixing rotator to form the fixing nip NP therebetween; and a heat source (e.g., the heat source 41) to heat the fixing rotator. As a recording medium (e.g., a sheet P) bearing a toner image T is conveyed through the fixing nip NP, the heated fixing rotator and the pressure rotator melt and fix the toner image T on the recording medium. As shown in FIG. 9, the fixing device 40 further includes a temperature sensor unit (e.g., the temperature sensor unit 52) including a plurality of temperature detection elements (e.g., the thermopiles 54*a* to 54*h*) disposed opposite the fixing rotator to detect the temperature of an outer circumferential surface of the fixing rotator without contacting the fixing rotator. As shown in FIG. 5, the heat source includes a plurality of heaters (e.g., the heaters 41*a*, 41*b*, and 41*c*) shifted from each other in an axial direction of the fixing rotator. At least two of the plurality of temperature detection elements (e.g., the thermopiles 54*g* and 54*b*) correspond to at least two heated spans (e.g., the center heated span S1 and the lateral end heated span S2) on the outer circumferential surface of the fixing rotator in the axial direction thereof that are heated by the plurality of heaters, respectively.

Accordingly, the plurality of temperature detection elements of the temperature sensor unit detects the temperature of the plurality of heated spans on the outer circumferential surface of the fixing rotator that is heated by the plurality of heaters, respectively. Consequently, the fixing device 40 reduces the number of temperature sensors that detect the temperature of the outer circumferential surface of the fixing rotator.

As shown in FIG. 5, the sheet P is conveyed over the fixing belt 47 in the conveyance span centered in the axial direction of the fixing belt 47. Alternatively, the conveyance span may be defined along one lateral edge of the fixing belt 47 in the axial direction thereof. In this case, the heater 41*c* is not necessary.

According to the exemplary embodiments described above, the fixing belt 47 serves as a fixing rotator. Alternatively, a fixing film, a fixing sleeve, a fixing roller, or the like may be used as a fixing rotator. Further, the pressure roller 43 serves as a pressure rotator. Alternatively, a pressure belt or the like may be used as a pressure rotator.

The present disclosure has been described above with reference to specific exemplary embodiments. Note that the present disclosure is not limited to the details of the embodiments described above, but various modifications and enhancements are possible without departing from the spirit and scope of the disclosure. It is therefore to be understood that the present disclosure may be practiced otherwise than as specifically described herein. For example, elements and/or features of different illustrative exemplary embodiments may be combined with each other and/or substituted for each other within the scope of the present disclosure.

What is claimed is:

1. A fixing device comprising:

a fixing rotator;

a pressure rotator pressed against the fixing rotator to form a fixing nip therebetween, through which a recording medium bearing a toner image is conveyed;

a first heater disposed opposite of and heating a first heated span on the fixing rotator spanning in an axial direction thereof;

a second heater disposed opposite of and heating a second heated span on the fixing rotator spanning in the axial direction thereof;

a temperature sensor unit disposed opposite of an outer circumferential surface of the fixing rotator, the temperature sensor unit including:

a first temperature detection element to detect a first temperature of the first heated span on the outer circumferential surface of the fixing rotator; and a second temperature detection element to detect a second temperature of the second heated span on the outer circumferential surface of the fixing rotator;

a calculator connectable to at least one of the first temperature detection element and the second temperature detection element to calculate output of the at least one of the first temperature detection element and the second temperature detection element;

a connection switch to connect the calculator to the at least one of the first temperature detection element and the second temperature detection element;

an abnormality monitor operatively connected to the calculator to detect an abnormality that at least one of the first temperature and the second temperature of the fixing rotator exceeds a predetermined upper limit temperature based on a calculation result provided by the calculator; and a breaker operatively connected to the abnormality monitor, the first heater, and the second heater to break power supply to the first heater while maintaining power supply to the second heater when the abnormality monitor detects the abnormality.

2. The fixing device according to claim 1, further comprising a third heater disposed opposite a third heated span on the fixing rotator spanning in the axial direction thereof, wherein the first heated span is a center span on the fixing rotator spanning in the axial direction thereof, the second heated span is one lateral end span on the fixing rotator spanning in the axial direction thereof, and the third heated span is another lateral end span on the fixing rotator spanning in the axial direction thereof.

3. The fixing device according to claim 2, wherein the second heater and the third heater are under an identical control.

4. The fixing device according to claim 1, wherein the temperature sensor unit is separable from the fixing rotator, the pressure rotator, the first heater, and the second heater.

5. The fixing device according to claim 4, further comprising a cover covering the fixing rotator and being separable from the temperature sensor unit, the cover including an aperture that exposes a part of the outer circumferential surface of the fixing rotator to the temperature sensor unit, wherein the temperature sensor unit is disposed opposite the fixing rotator through the aperture of the cover.

6. The fixing device according to claim 5, wherein the cover further includes a shutter to block the aperture as the cover separates from the temperature sensor unit.

7. The fixing device according to claim 1, wherein the connection switch connects the calculator to the first temperature detection element and the second temperature detection element alternately.

8. The fixing device according to claim 1, further comprising a temperature detector disposed opposite the fixing rotator and including a circuit board mounting the temperature sensor unit, the calculator, the connection switch, and the abnormality monitor, the temperature detector being separable from the fixing rotator, the pressure rotator, the first heater, and the second heater.

9. The fixing device according to claim 1, wherein each of the first temperature detection element and the second temperature detection element includes a thermopile.

10. The fixing device according to claim 1, wherein the fixing rotator includes a fixing belt and the pressure rotator includes a pressure roller.

11. The fixing device according to claim 1, wherein each of the first heater and the second heater includes a halogen heater.

12. The fixing device of claim 1, wherein:

the first temperature corresponds to at least two heated spans on the outer circumferential surface of the fixing rotator that are each heated by a different heater; and the second temperature corresponds to at least two heated spans on the outer circumferential surface of the fixing rotator that are each heated by a different heater.

13. An image forming apparatus comprising:

an image forming device to form a toner image;

a fixing rotator disposed downstream from the image forming device in a recording medium conveyance direction to fix the toner image on a recording medium;

a pressure rotator pressed against the fixing rotator to form a fixing nip therebetween, through which the recording medium bearing the toner image is conveyed;

a first heater disposed opposite and directly heating a first heated span on the fixing rotator spanning in an axial direction thereof;

a second heater disposed opposite and directly heating a second heated span on the fixing rotator spanning in the axial direction thereof;

a temperature sensor unit disposed opposite an outer circumferential surface of the fixing rotator, the temperature sensor unit including:

a first temperature detection element to detect a first temperature corresponding to at least two heated spans on the outer circumferential surface of the fixing rotator that are each heated by a different heater; and a second temperature detection element to detect a second temperature corresponding to at least two heated spans on the outer circumferential surface of the fixing rotator that are each heated by a different heater; and a breaker that is operatively connected to the first heater and the second heater, and that is adapted to break power supply to the first heater while maintaining power supply to the second heater, based on input from the temperature sensor unit indicating an abnormality.

* * * * *